US006109476A

United States Patent [19]

Thompson et al.

[11] Patent Number: 6,109,476

[45] Date of Patent: Aug. 29, 2000

[54] ICE DISPENSING SYSTEM

[75] Inventors: Virgil R. Thompson, Cameron; Donald R. Bitts, deceased, late of Galesburg, by Lorraine W. Bitts, heiress; Walter I. Disbennett, Knoxville, all of Ill.

[73] Assignee: Maytag Corporation, Newton, Iowa

[21] Appl. No.: 09/126,434

[22] Filed: Jul. 30, 1998

[51] Int. Cl.[7] ..... G01F 11/00

[52] U.S. Cl. ..... 222/1; 222/146.6; 222/412; 241/243; 241/DIG. 17

[58] Field of Search ..... 222/1, 146.6, 240, 222/241, 242, 412, 413; 241/243, DIG. 17

[56] References Cited

U.S. PATENT DOCUMENTS

| | | | |
|---|---|---|---|
| 3,602,441 | 8/1971 | Alvarez | 241/101 |
| 3,824,805 | 7/1974 | Prada | 62/320 |
| 3,843,067 | 10/1974 | Prada | 241/190 |
| 3,889,888 | 6/1975 | Prada | 241/101.1 |
| 4,176,527 | 12/1979 | Linstomberg et al. | 62/320 |
| 4,972,999 | 11/1990 | Grace | 241/243 |
| 5,125,242 | 6/1992 | von Blanquet | 62/320 |
| 5,201,475 | 4/1993 | Nakagomi | 241/243 |
| 5,273,219 | 12/1993 | Beach, Jr. et al. | 241/65 |

*Primary Examiner*—Joseph A. Kaufman
*Attorney, Agent, or Firm*—Everett G. Diederiks, Jr.

[57] ABSTRACT

An ice dispenser system incorporates a common ice delivery passage for both cubed and crushed ice. A first set of ice crushing blades are mounted upon a shaft that rotates concurrently with an ice delivery element such as an auger. When cubed ice is desired, an unobstructed ice delivery path is provided with the second set of ice crushing blades being pivoted out of the passage and the first set of ice crushing blades simply rotating within the passage to aid in delivering ice to an ice receiving area. Preferably, the second set of ice crushing blades are pivoted through the use of a crank arm that has a first bent end received in a slot formed in the second set of ice crushing blades and a second bent end that is acted upon by an output member of a solenoid attached to a rear portion of an ice collecting bin of the system. When crushed ice is desired, the second set of ice crushing blades is arranged in the delivery path such that the second set of ice crushing blades is interleaved with the first set of rotating crushing blades so the ice will be crushed between the two sets of blades.

20 Claims, 4 Drawing Sheets

ICE DISPENSING SYSTEM

BACKGROUND OF THE INVENTION

1. Field of the Invention

The present invention pertains to the art of refrigerators and, more particularly, to a system for selectively dispensing cubed or crushed ice from a refrigerator.

2. Discussion of the Prior Art

It is now common practice in the art of refrigerators to provide an automatic ice maker within a freezer compartment of a refrigerator and further to provide a system for dispensing the ice into a recessed receiving area formed in a front panel of the refrigerator. In essence, these systems provide for the automatic filling of ice cube trays which are emptied into a bin following a freezing period. From the bin, the ice can be delivered to the receiving area by the selective activation of a drive unit such as a rotatable auger located within the bin. Most often, such ice dispensing systems incorporate a mechanism whereby the ice can be selectively crushed prior to reaching the receiving area.

In the industry, there has heretofore been proposed various different systems to accomplish this ice dispensing function. In general, these systems differ in the particular manner in which the cubed and crushed ice are delivered to the receiving area and the way in which the ice is actually crushed. For example, with respect to the manner in which the cubed and crushed ice are delivered, it is known in the art to incorporate two doors in an ice dispensing system with one of the doors functioning to direct cubed ice to the crushing area and the other door being used to deliver the cubed or crushed ice to the receiving area. Therefore, depending on the position of a user controlled selector unit, either one or both of the doors will be open for the delivery of ice. In another known system, an auger is rotated in opposite directions for dispensing the cubed and crushed ice respectively. Unfortunately, these ice delivery systems either suffer from an inherent time delay in the delivery of cubed ice following a crushed ice dispensing operation and/or, upon dispensing cubed ice for the first time after dispensing crushed ice, an avalanche of remaining crushed ice is received.

With respect to the manner in which the ice can be crushed in these prior art systems, numerous types of ice crushing mechanisms have been proposed. For example, it is known to provide multiple sets of crushing blades which rotate about a common axis with an auger with one of the blade sets being fixed for rotation with the auger and the other blade set being freely rotatable about the common axis. When crushed ice is selected, the freely rotatable blade set is secured against rotation such that the cubes of ice are crushed between the two sets of blades. In another known system, an anvil member can be positioned in an ice delivery passage and cubes of ice can be crushed between the anvil member and a single set of blades which rotated with the ice delivery auger. Finally, it is also known to linearly shift a first set of ice crushing blades into an ice delivery path so that cubes of ice can be crushed between the first set of blades and a second set of blades which rotates with the ice delivery auger. Unfortunately, such known systems suffer from various drawbacks including cost, durability and crushing effectiveness factors.

Therefore, there exists a need in the art for an improved ice dispensing system which is simple in structure so as to be cost efficient while still being durable and wherein cubed and crushed ice can be selectively dispensed in a timely and accurate manner.

SUMMARY OF THE INVENTION

The ice dispensing system of the present invention includes various aspects which combine to enable an enhanced overall dispensing operation to be accomplished in a timely and accurate manner. According to the invention, cubed ice is delivered from an ice collecting bin, preferably through a conventional auger drive unit, to a common ice delivery passage for the dispensing of both cubed and crushed ice. Utilizing a single, common delivery passage aids in simplifying the overall system construction while enhancing the timeliness of the ice delivery. A first set of ice crusher blades is mounted upon a shaft that rotates concurrently with the ice delivery auger. When cubed ice is to be dispensed, the ice delivery passage is unobstructed with the first set of blades merely rotating within the path of the ice to aid in the efficient delivery of the ice to an ice receiving area. When crushed ice is desired, a second set of ice crusher blades is pivoted into the ice delivery passage such that they are interleaved with the first set of rotating crusher blades. In the preferred embodiment, the second set of ice crusher blades are biased by a spring into a crushing position within the ice delivery passage but can be pivoted out of the ice delivery passage through the use of a solenoid which is mounted at a rear of the ice collecting bin and functions to rotate a crank arm which, in turn, includes an end portion extending within a slot formed in the second set of ice crusher blades. In this fashion, the simple activation or de-activation of the solenoid causes the second set of crusher blades to be moved either out of or into the ice delivery passage.

With this arrangement, a single, relatively short ice delivery passage can be used to deliver both cubed and crushed ice by simply, selectively pivoting a second set of ice crusher blades out of and into the path of the ice respectively. This has been found to effectively prevent undesired avalanching of the ice from one dispensing operation to another while minimizing dispensing time. Utilizing two sets of ice crusher blades assures that the ice will be effectively crushed when desired. In addition, pivoting the second set of ice crusher blades with a crank arm in a slot arrangement through the use of a solenoid located at a rear portion of the ice collecting bin provides for an overall effective and durable ice dispensing system.

Additional features and advantages of the ice dispensing system of the invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
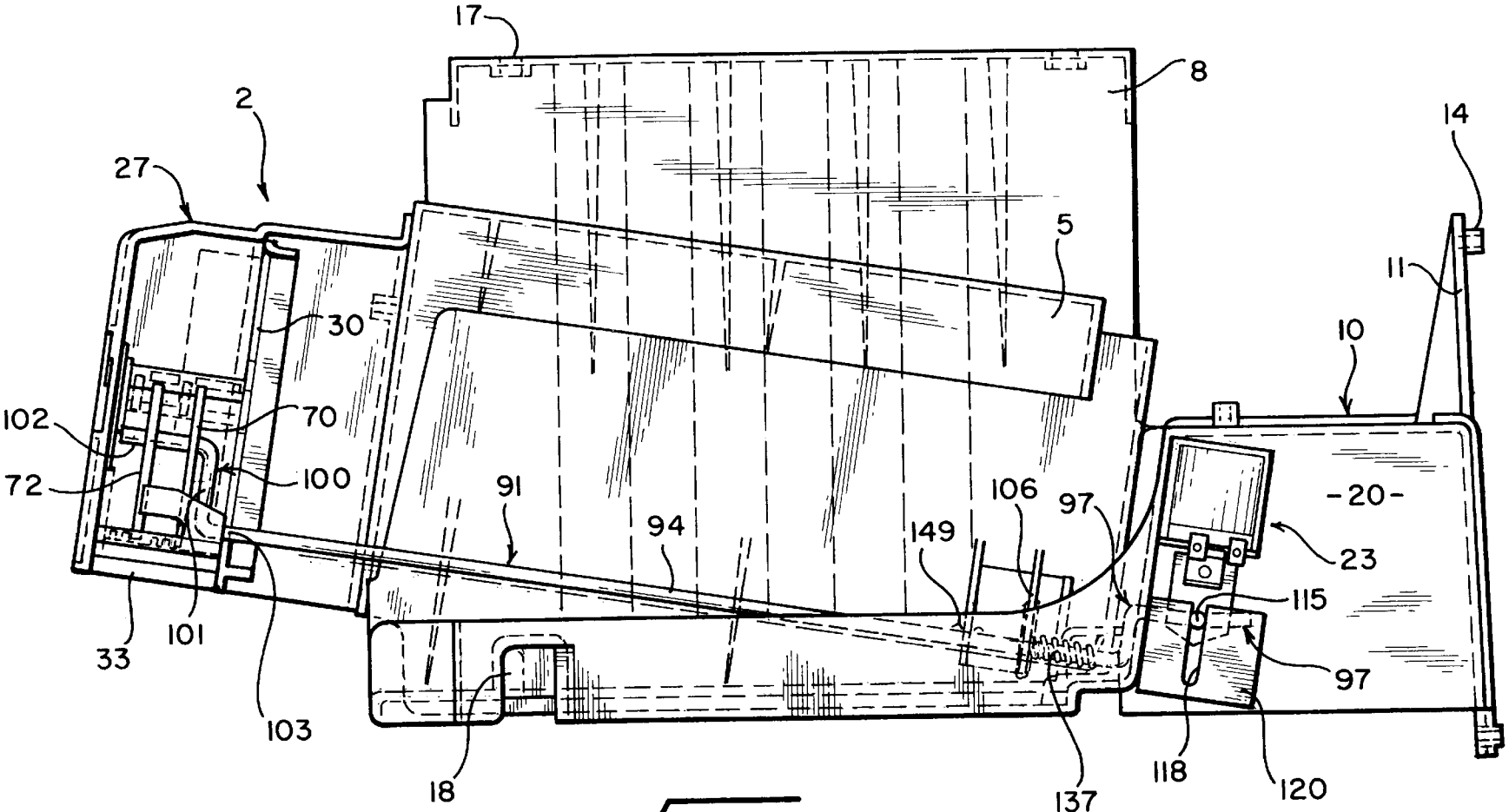
FIG. 1 is a schematic side view of the ice dispensing system of the invention.

With initial reference to FIG. 1, the ice dispensing system of the invention is generally indicated at 2. Ice dispensing system 2 includes an ice receiving bin 5 that is slidably, removably mounted within a casing 8. Casing 8 includes an extension section 10 provided with a mounting plate portion 11. Mounting plate portion 11 includes a plurality of mounting holes 14 that are used to secure an icemaker to the casing 8. Additional mounting holes 17 are formed at an upper section of casing 8 and further mounting holes 18 are formed at a lower section of casing 8. Mounting holes 17 and 18 are used to secure casing 8 within a freezer section of a conventional refrigerator. Extension section 10 generally defines an encased area 20 within which is mounted a cubed-to-crushed ice selector mechanism 23 which will be more fully described below.

Bin 5 has secured thereto a frontal housing portion 27. Frontal housing portion 27 is open to within bin 5 by means of an ice receiving inlet 30. Frontal housing portion 27 also includes an ice delivery outlet 33 which leads to an ice receiving area (not shown) defined by a recess formed in a front panel of the refrigerator as is widely known in the art. In general, bin 5 is adapted to receive cubes of ice which are formed by an automatic ice maker unit (not shown) and the cubes of ice are adapted to be delivered by means of a drive unit, such as an auger, to ice receiving inlet 30 of frontal housing portion 27. Since such automatic ice makers and driving units are widely known in the art and not considered part of the present invention, they have not been shown in the drawings and will not be discussed herein in detail.

Figure 2:
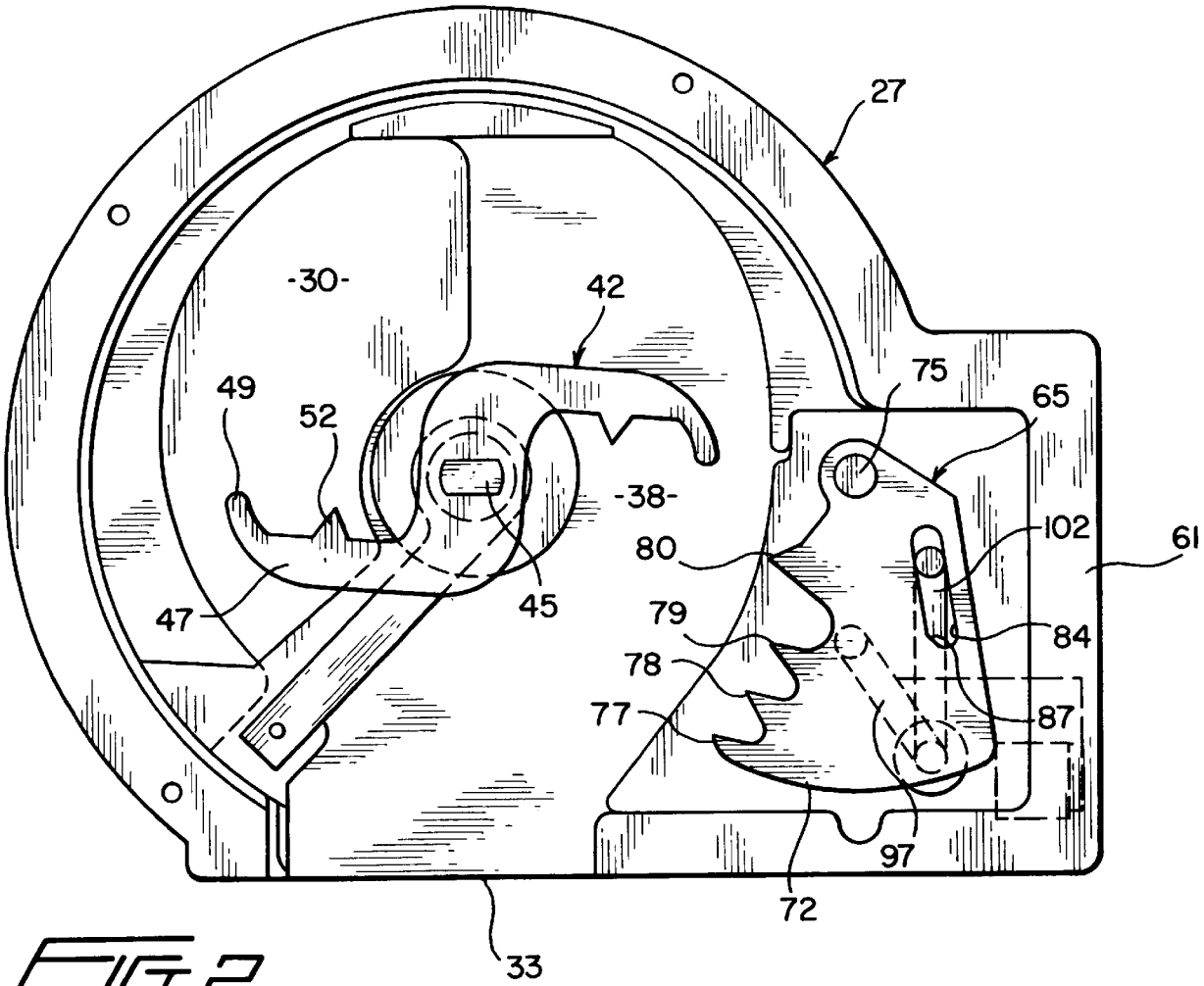
FIG. 2 is a front view of the ice dispenser with the second set of ice crusher blades shown in a retracted position.
Figure 3:
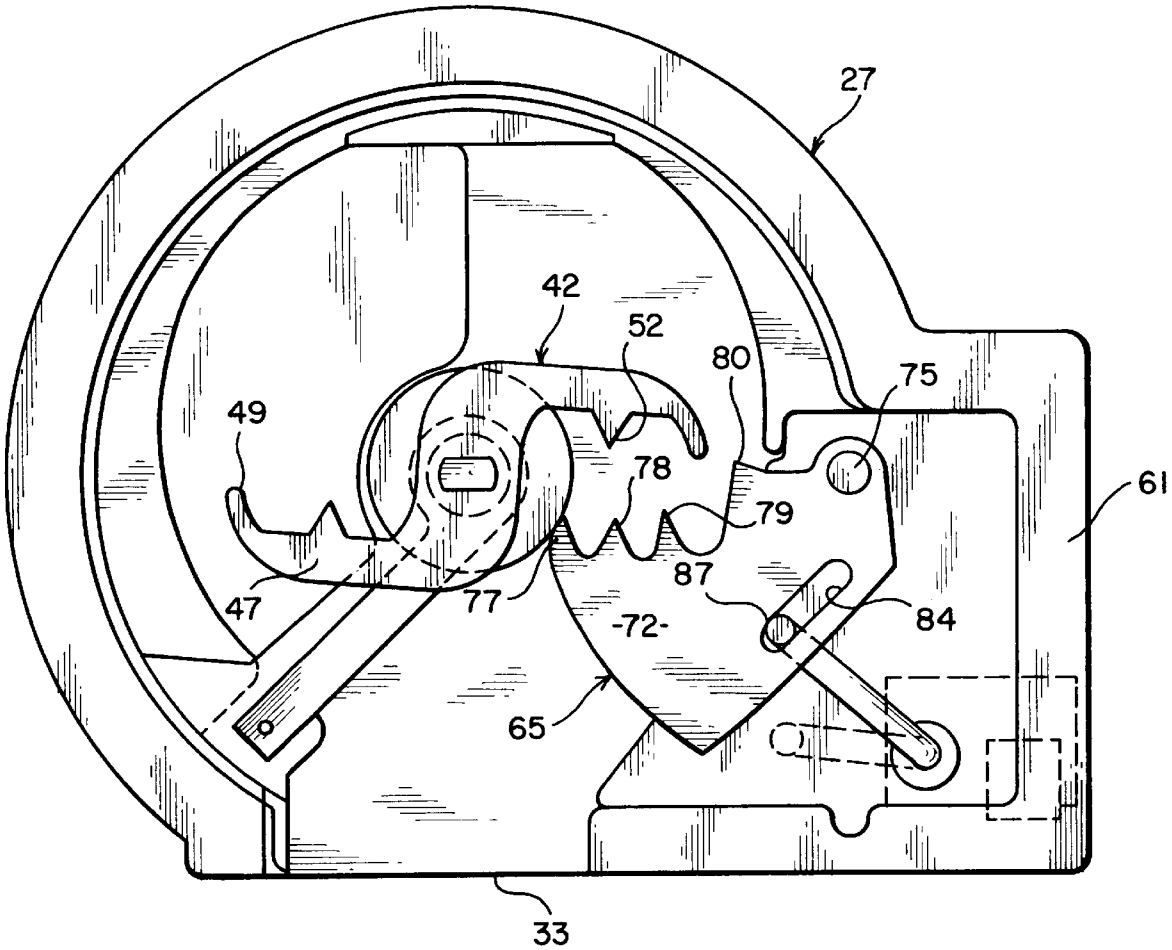
FIG. 3 is a front view similar to that of FIG. 2 with the second set of ice crusher blades in an extended position.

As best shown in FIGS. 2 and 3, frontal housing portion 27 defines an ice delivery passage 38 that leads from ice receiving inlet 30 to ice delivery outlet 33. Rotatably mounted within frontal housing portion 27 is a first set of ice crushing blades 42 which are mounted for rotation with a shaft 45. Shaft 45 constitutes part of the drive unit used to deliver ice from bin 5 into ice delivery passage 38 and therefore, the first set of ice crushing blades 42 rotates with shaft 45 whenever ice is to be dispensed. Each blade of the first set of ice crushing blades 42 includes a pair of identical arms 47 having a curved terminal tip 49 and at least one sharp pointed tooth 52.

Frontal housing portion 27 is also formed with an extension housing portion 61 for storing a second set of ice crushing blades 65. More specifically, the second set of ice crushing blades 65 are defined by a pair of axially spaced plates 70, 72 (also see FIG. 1) which are pivotally mounted to frontal housing portion 27 by means of a pin 75. Each of the second set of ice crushing blades 65 is formed with a plurality of sharp teeth 77-80 and a slot 84. As best shown in FIG. 2, one end of each slot 84 is formed with a ramp portion 87 which will be discussed further below.

As should be readily apparent from the description given above and from viewing FIGS. 2 and 3, the second set of ice crushing blades 65 can be pivoted about an axis defined by pin 75 from a retracted, non-use position as shown in FIG. 2 to an extended, in-use position as shown in FIG. 3. When the second set of ice crushing blades 65 is retracted, ice cubes delivered into ice receiving inlet 30 will be caused to fall through ice delivery passage 38 and out ice delivery outlet 33 with the aid of the rotating set of first ice crushing blades 42. Therefore, when the second set of ice crushing blades 65 is retracted, ice dispensing system 2 enables cubes of ice to be delivered from bin 5 directly to the ice receiving area. When the second set of ice crushing blades 65 is extended, cubes of ice delivered into ice delivery passage 38 will be crushed between the interleaved first and second sets of ice crushing blades 42 and 65. Although the particular number of blades in each of the first and second sets of ice crushing blades 42 and 65 can vary in accordance with the invention, in the preferred embodiment, three axially spaced blades are provided for the first set of ice crushing blades 42 and two, axially spaced blades are provided for the second set of ice crushing blades 65.

Figure 4:
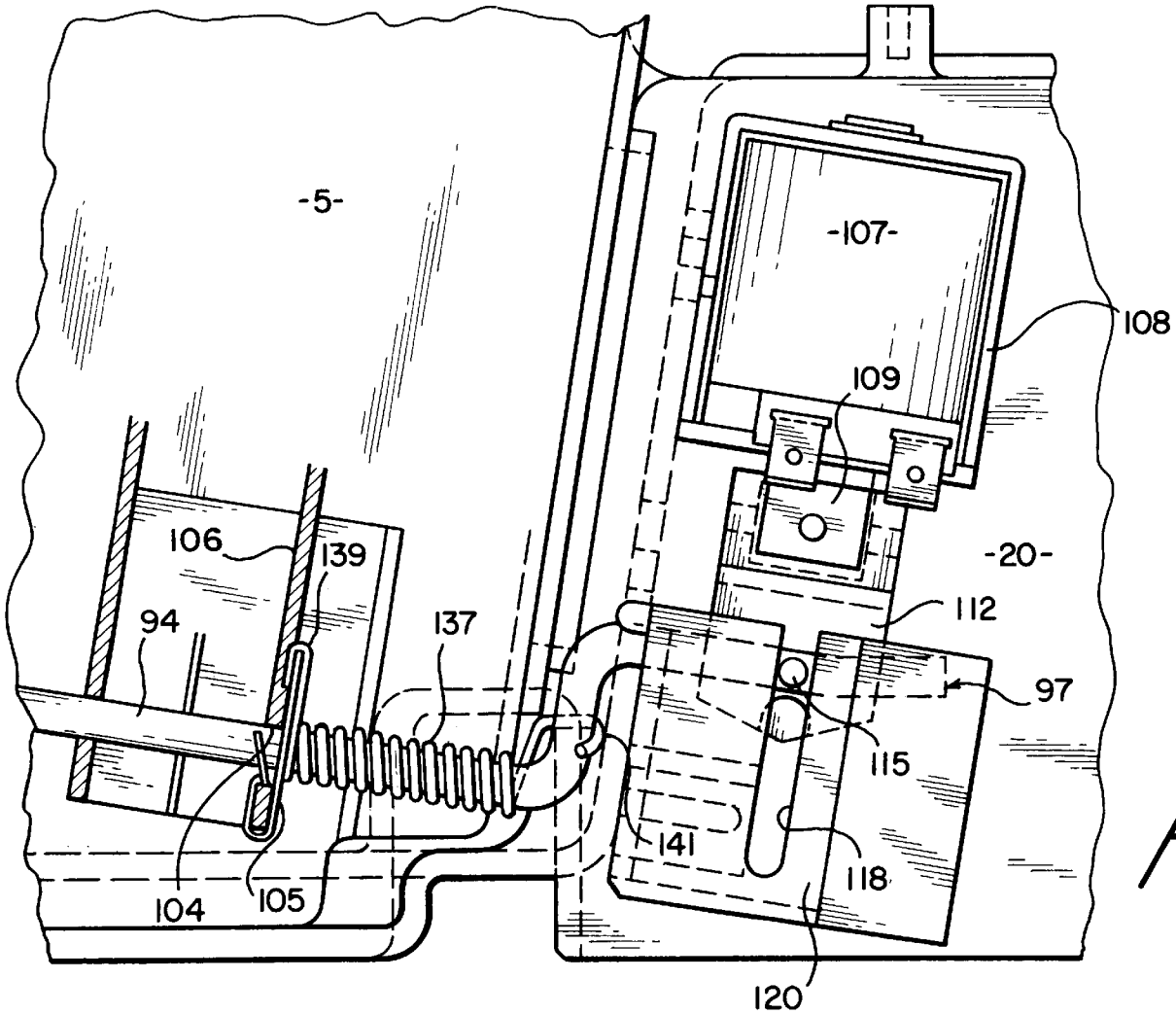
FIG. 4 is an enlarged view of a rear portion of the ice dispensing system of FIG. 1.

The particular manner in which the second set of ice crushing blades 65 is pivoted between the retracted and extended positions will now be discussed. As best shown in FIG. 1, a crank arm 91 includes an intermediate portion 94, a first bent end portion 97 and a second bent end portion 100. Second bent end portion 100 includes a first bent section 101 and a second bent section 102. As clearly shown in these Figures, second bent section 102 extends through the slot 84 provided in each blade 70, 72 of the second set of ice crushing blades 65. Intermediate portion 94 of crank arm 91 is rotatably mounted to bin 5 by extending through a hole 103 formed in frontal housing portion 27 (see FIG. 1) and through slot 104 formed in a metal clip 105 attached to a downwardly extending flange 106 provided adjacent the rear end of bin 5 as best shown in FIG. 4. In the preferred embodiment, metal clip 105 is attached to flange 106 by barbs which frictionally retain clip 105 on a lower portion of flange 106 as clearly shown in FIG. 4.

With particular reference to FIGS. 1 and 4, a solenoid 107 is mounted to casing 8 within encased area 20 through a bracket 108. Solenoid 107 includes a linear output member 109 which is connected to a yoke 112. Yoke 112 carries a pin 115 that extends within a slot 118 of a guide member 120. First bent end portion 97 of crank arm 91 is slidably mounted to a position between spaced arms of yoke 112 when bin 5 is inserted within casing 8 such that upward linear movement of output member 109 of solenoid 107 causes first bent end portion 97 to shift generally upward (shown in FIG. 4) which results in rotation of intermediate portion 94 and a movement of second bent end portion 100. This movement causes the second set of ice crushing blades 65 to be pivoted from its extended position to its retracted position as shown in FIGS. 3 and 2 respectively. In the preferred embodiment, the second set of ice crushing blades 65 is preferably biased to its extended position shown in FIG. 3 by means of a spring 137. Spring 137, as best shown in FIG. 4, is coiled about a section of intermediate portion of 94 adjacent first bent end portion 97 and includes a first end 139 which extends over clip 105 and abuts flange 106 and a second end 141 that defines a terminal loop that extends about a section of first bent end portion 97. With this arrangement, crank arm 91 is biased to move from the blade retracted position shown in FIG. 1 to the position shown in FIG. 3 wherein the second set of ice crushing blades 65 assume the extended position. In order to prevent undesired axial shifting of crank arm 91 toward frontal housing portion 27, projections 149 on crank arm 91 are provided adjacent clip 105 as shown in FIG. 1. In addition, first end 139 of spring 137 extends over clip 105 to further prevent undesired axial shifting of crank arm 91.

With this arrangement, it should be readily apparent that ice delivery passage 38 is common for both the delivery of cubed and crushed ice. In addition, the provision of teeth on both sets of ice crushing blades 42 and 65 assures effective and consistent crushing of the ice when the second set of ice crushing blades 65 is extended into the path of the cubes of ice forced into ice delivery passage 38. Furthermore, remote activation of the second set of ice crushing blades 65 through solenoid 107 assures a durable arrangement since the solenoid 107 remains fixed even when bin 5 is removed from casing 8 while the presence of spring 137 assures a consistent angular positioning of crank arm 91 so that crank arm 91 can be readily inserted and removed from between the arms of the yoke 112. Finally, the presence of ramp portion 87 in each slot 84 assures a smooth transition to the fully extended, in-use position for the second set of ice crushing blades 65 to aid in increasing the useful life of the system, particularly by acting as a type of braking mechanism which prevents harsh, undo shocks upon the pivoting mechanism.

Although described with respect to a preferred embodiment of the invention, it should be readily understood that various changes and/or modifications may be made to the invention without departing from the spirit thereof. For example, although spring 137 biases the second set of ice crushing blades 65 to an ice crushing position and solenoid 107 is energized to retract the second set of ice crushing blades 65 in the preferred embodiment described, it should be realized that the second set of ice crushing blades 65 could be biased to a cubed dispensing position and shifted to a ice crushing position by a solenoid. Furthermore, other known mechanisms could also be utilized to perform this shifting function without departing from the invention. In general, the invention is only intended to be limited by the scope of the following claims.

We claim:

1. An ice dispensing system comprising:

a bin for collecting cubed ice;

a frontal housing attached to said bin, said frontal housing including an upper ice receiving inlet leading into said frontal housing from said bin and a lower ice delivery outlet, said frontal housing defining an ice delivery passage leading from said upper ice receiving inlet to said lower ice delivery outlet, said frontal housing further including an extension housing portion opening into said ice delivery passage;

a rotatable shaft extending within said frontal housing, said shaft defining an axially extending axis;

a first blade unit drivingly coupled for rotation with said shaft, said first blade unit including a plurality of radially extending arms each of which has at least one sharp tooth;

a second blade unit including at least two axially spaced plates each having at least one sharp tooth, said second blade unit being pivotally mounted about a rotational axis to said frontal housing for movement between an in-use position wherein said second blade unit extends into said ice delivery passage and a non-use position wherein said second blade unit is retracted within said extension housing portion; and means for selectively pivoting said second blade unit between said in-use and non-use positions wherein, when said second blade unit is placed in said non-use position, cubed ice can be delivered from said bin to said ice delivery outlet through said ice receiving inlet and said ice delivery passage with said first blade unit aiding in propelling the cubed ice through said ice delivery passage and, when said second blade unit is placed in said in-use position, said first and second blade units are interleaved so that cubed ice within said ice delivery passage is crushed between said first and second blade units in order to obtain crushed ice from said ice dispensing apparatus.

2. The ice dispensing system according to claim 1, wherein said means for selectively pivoting said second blade unit comprises a linear solenoid.

3. The ice dispensing system according to claim 2, wherein said means for selectively pivoting said second blade unit further comprises a crank arm having first and second end portions interconnected by an elongated intermediate portion, said intermediate portion being rotatable relative to said bin about a longitudinal axis, said first end portion being connected to an output member of said linear solenoid and said second end portion being attached to said second blade unit at locations offset from said longitudinal axis whereby linear movement of the output member of said linear solenoid causes rotation of said crank arm and pivoting of said second blade unit.

4. The ice dispensing system according to claim 3, further comprising a yoke member attached to the output member of said linear solenoid, the first end portion of said crank arm being received within said yoke member.

5. The ice dispensing system according to claim 3, wherein said linear solenoid and the first end portion of said crank arm are located at a rear end of said bin.

6. The ice dispensing system according to claim 3, wherein said second blade unit includes a plate formed with a slot, the second end portion of said crank arm extending within said slot.

7. The ice dispensing system according to claim 6, wherein said slot includes a ramp portion at a terminal end thereof.

8. The ice dispensing system according to claim 6, wherein said means for selectively pivoting said second blade further comprises spring means biasing said second blade unit towards said in-use position.

9. The ice dispensing system according to claim 8, wherein said spring means acts between said crank arm and said bin.

10. The ice dispensing system according to claim 9, wherein said spring means is coiled about a section of said crank arm.

11. The ice dispensing system according to claim 1, wherein said means for selectively pivoting said second blade unit comprises spring means biasing said second blade unit towards said in-use position.

12. The ice dispensing system according to claim 1, wherein said second blade unit incorporates more teeth than said first blade unit.

13. An ice dispensing system comprising:

a bin for collecting cubed ice;

a frontal housing attached to said bin, said frontal housing including an upper ice receiving inlet leading into said frontal housing from said bin and a lower ice delivery outlet, said frontal housing defining an ice delivery passage leading from said upper ice receiving inlet to said lower ice delivery outlet, said frontal housing further including an extension housing portion opening into said ice delivery passage;

a rotatable shaft extending within said frontal housing, said shaft defining an axially extending axis;

a first blade unit drivingly coupled for rotation with said shaft, said first blade unit including a plurality of radially extending arms each of which has at least one sharp tooth;

a second blade unit including at least two axially spaced plates each having at least one sharp tooth, said second blade unit being pivotally mounted about a rotational axis to said frontal housing for movement between an in-use position wherein said second blade unit extends into said ice delivery passage and a non-use position wherein said second blade unit is retracted within said extension housing portion; and a mechanism connected to said second blade unit for pivoting said second blade unit between said in-use and non-use positions wherein, when said second blade unit is placed in said non-use position, cubed ice can be delivered from said bin to said ice delivery outlet through said ice receiving inlet and said ice delivery passage with said first blade unit aiding in propelling the cubed ice through said ice delivery passage and, when said second blade unit is placed in said in-use position, said first and second blade units are interleaved so that cubed ice within said ice delivery passage is crushed between said first and second blade units in order to obtain crushed ice from said ice dispensing apparatus.

14. The ice dispensing system according to claim 13, wherein said mechanism comprises a linear solenoid.

15. The ice dispensing system according to claim 14, wherein said mechanism comprises a crank arm having first and second end portions interconnected by an elongated intermediate portion, said intermediate portion being rotatable relative to said bin about a longitudinal axis, said first end portion being connected to an output member of said linear solenoid and said second end portion being attached to said second blade unit at locations offset from said longitudinal axis whereby linear movement of the output member of said linear solenoid causes rotation of said crank arm and pivoting of said second blade unit.

16. The ice dispensing system according to claim 15, wherein said second blade unit includes a plate formed with a slot, the second end portion of said crank arm extending within said slot.

17. The ice dispensing system according to claim 16, wherein said slot includes a ramp portion at a terminal end thereof.

18. A method of dispensing either cubed or crushed ice comprising:

delivering cubed ice from a bin to an ice delivery passage formed in a frontal housing attached to said bin;

rotatably mounting a first blade unit having a plurality of ice crushing teeth within said ice delivery passage;

permitting the cubed ice to unobstructively flow through said ice delivery passage to an ice delivery outlet when cubed ice is desired; and pivoting, about a rotational axis, a second blade unit having a plurality of ice crushing teeth into an in-use position wherein the second blade unit is interleaved with said first blade unit within said ice delivery passage when crushed ice is desired such that the cubed ice delivered into the ice delivery passage is crushed between the first and second blade units and crushed ice is delivered to the ice delivery outlet.

19. The dispensing method according to claim 18, further comprising:

biasing said second blade unit towards said in-use position for the delivery of crushed ice.

20. The dispensing method according to claim 18, further comprising:

pivoting the second blade unit from said in-use position by rotating a crank arm through the shifting of a linear output member of a solenoid located at a rear portion of said bin.

* * * * *